US009718167B2

(12) United States Patent
Ihara et al.

(10) Patent No.: US 9,718,167 B2
(45) Date of Patent: Aug. 1, 2017

(54) FLUID NOZZLE

(71) Applicant: Sugino Machine Limited, Uozu-shi, Toyama (JP)

(72) Inventors: Minoru Ihara, Uozu (JP); Masanori Kanemitsu, Uozu (JP); Takahiko Ogura, Uozu (JP)

(73) Assignee: SUGINO MACHINE LIMITED, Uozu-shi (JP)

( * ) Notice: Subject to any disclaimer, the term of this patent is extended or adjusted under 35 U.S.C. 154(b) by 0 days.

(21) Appl. No.: 14/602,850

(22) Filed: Jan. 22, 2015

(65) Prior Publication Data

US 2015/0209936 A1 Jul. 30, 2015

(30) Foreign Application Priority Data

Jan. 27, 2014 (JP) ..... 2014-012573

(51) Int. Cl.

| | |
|---|---|
| ***A62C 31/02*** | (2006.01) |
| ***B24C 5/04*** | (2006.01) |
| ***B05B 1/10*** | (2006.01) |
| ***B26F 3/00*** | (2006.01) |

(52) U.S. Cl.

CPC ..... *B24C 5/04* (2013.01); *B05B 1/10* (2013.01); *B26F 3/004* (2013.01)

(58) Field of Classification Search

CPC ..... B24C 5/04; B05B 1/10; B26F 3/004
USPC ..... 239/589
See application file for complete search history.

(56) References Cited

U.S. PATENT DOCUMENTS

| | | | | |
|---|---|---|---|---|
| 3,875,971 | A * | 4/1975 | Hamling | C04B 35/46 138/146 |
| 4,280,662 | A * | 7/1981 | Erickson | F04F 5/46 239/591 |
| 4,936,512 | A * | 6/1990 | Tremoulet, Jr. | B05B 1/00 239/596 |
| 7,862,405 | B2 * | 1/2011 | Hashish | B26F 3/004 451/102 |
| 7,934,977 | B2 * | 5/2011 | Hashish | B24C 1/045 451/102 |
| 2002/0179744 | A1 * | 12/2002 | Noelle | D04H 18/04 239/556 |
| 2005/0017091 | A1 * | 1/2005 | Olsen | B24C 1/045 239/400 |
| 2014/0151582 | A1 * | 6/2014 | Rollinger | B05B 1/02 250/504 R |

* cited by examiner

*Primary Examiner* — Arthur O Hall
*Assistant Examiner* — Adam J Rogers
(74) *Attorney, Agent, or Firm* — Rankin, Hill & Clark LLP

(57) ABSTRACT

A fluid nozzle includes a nozzle chip that includes a through hole having an inlet port from which a fluid supplied to the fluid nozzle is introduced and an outlet port from which the introduced fluid is ejected; and a base metal member that supports the nozzle chip embedded in a rear portion of the base metal member. The fluid nozzle receives the fluid supplied to the rear portion from the inlet port and ejects the fluid from the outlet port. An exposed portion of the base metal member is covered with a ceramic coating so that the base metal member does not touch the fluid.

9 Claims, 7 Drawing Sheets

FLUID NOZZLE

CROSS REFERENCES TO RELATED APPLICATIONS

The present invention contains subject matter related to Japanese Patent Application No. 2014-012573 filed in the Japan Patent Office on Jan. 27, 2014, the entire contents of which are incorporated herein by reference.

BACKGROUND OF THE INVENTION

1. Field of the Invention

The present invention relates to fluid nozzles and particularly to a fluid nozzle including a base metal member having a rear portion covered with a ceramic coating.

2. Description of the Related Art

Water jet processing machines perform cutting or other operations using a water jet (a liquid column made of a fluid jet), which is a high-pressure fluid (for example, water or highly pure water). The water jet processing machines are characterized in that they produce a relatively small cutting width and less frequently cause seizure of a material or change the composition of a material. Thus, the water jet processing machines are used to perform operations such as to cut expensive materials or to process fine grooves.

These days, in order to minimize processing steps and the amount of materials that are to be wasted during processing, precision finished products that do not require finishing using a water jet have been increasingly demanded.

Thus, a processing apparatus that processes a material using a laser beam guided by a water jet has been developed (hereinafter such an apparatus is referred to as a "water beam processing machine" (for example, see Japanese Patent No. 5220914). The water beam processing machine is advantageous in that it can highly precisely finish products since the material is negligibly deformed by heat.

To highly precisely finish products in water jet processing, a water jet from a water-jet fluid nozzle is required to be ejected through the nozzle center so as to be parallel to the nozzle axis while the water jet keeps a stable liquid-beam diameter.

To date, a water-jet-processing fluid nozzle in which a nozzle orifice made of a diamond is embedded in a nozzle body that fixes a nozzle chip thereto (for example, see FIG. 2 of Japanese Unexamined Patent Application No. 2009-78313) is known.

In the fluid nozzle described in Japanese Unexamined Patent Application No. 2009-78313, a portion of the nozzle body that is exposed to a high-pressure fluid (high-pressure water) is made of a resin material in order that a workpiece can be prevented from being contaminated by a water jet into which metal in the nozzle body is dissolved and mixed as a result of the high-pressure water coming into contact with the nozzle body.

However, the strength of the fluid nozzle described in Japanese Unexamined Patent Application No. 2009-78313, which includes a resin portion in the nozzle body that fixes the nozzle chip thereto, may be insufficient to hold the nozzle orifice for use in highly precise finishing of products. Thus, disadvantageously, this fluid nozzle is insufficient to precisely position the nozzle orifice and firmly and stably hold the nozzle orifice.

In some cases, water hammer occurs in the nozzle body during the supply of a high-pressure water or when the supply of the high-pressure water is stopped, exerting a strong impact force on the nozzle body. In the case where the nozzle body is used in a laser beam processing machine such as the one disclosed in Japanese Patent No. 5220914, the nozzle body is required to have such rigidity and durability as to be capable of stably holding the nozzle chip since the nozzle chip and its vicinity may be damaged as a result of being exposed to a strong laser beam.

In the case where the nozzle body is damaged by the impact pressure and the laser beam, the flow of the high-pressure water around the inlet port of the nozzle chip is disturbed and becomes irregular and unstable, conceivably failing to form a stable water jet.

SUMMARY OF THE INVENTION

In view of these problems, it is an object of the present invention to provide a fluid nozzle that can form a highly precise, stable water jet and that can have improved rigidity and durability.

In view of the object, a first aspect of the present invention is a fluid nozzle that includes a nozzle chip that includes a through hole having an inlet port from which a fluid supplied to the fluid nozzle is introduced and an outlet port from which the introduced fluid is ejected; and a base metal member that supports the nozzle chip embedded in a rear portion of the base metal member, wherein the fluid nozzle receives the fluid supplied to the rear portion from the inlet port and ejects the fluid from the outlet port, and wherein an exposed portion of the base metal member is covered with a ceramic coating so that the base metal member does not come into contact with the fluid.

In such a configuration, the nozzle chip is held by the base metal member. Thus, the nozzle chip is thus firmly held and has a high rigidity and long-term durability. In addition, since the exposed portion of the base metal member is covered with the ceramic coating, the supplied fluid does not touch the base metal member. This configuration thus can prevent metal contained in the base metal member from dissolving into the fluid, whereby a workpiece can be prevented from being contaminated by metal dissolved from the base metal member.

The inventors of the application have newly observed, through experiments, that the high pressure of a fluid causes a phenomenon in which metal dissolved into the fluid precipitates in the form of a crystal around the inlet port of the nozzle chip (the phenomenon is referred to as pressure induced crystallization).

Here, pressure induced crystallization is a phenomenon in which crystals precipitate when a mixture is pressurized at a high pressure of several thousand atmospheres and the pressure induced crystallization is used in various fields such as a chemical industrial field as a method of crystallization. The pressure induced crystallization causes metal (crystallized metal) that has adhered to the nozzle chip to gradually grow into crystal. Thus, a phenomenon can be observed in which the flow of the fluid introduced into the inlet port receives irregular resistance and a water jet ejected through the outlet port is deviated. Thus, the pressure induced crystallization has to be effectively prevented.

According to the present invention, a highly precise stable water jet can be formed while the water jet is prevented from being deviated or inclined by the crystallized metal caused by dissolved metal because the supplied fluid does not touch the base metal member having an exposed portion covered with a ceramic coating and thus metal does not dissolve into the supplied fluid from the base metal member.

A second aspect of the present invention is the fluid nozzle according to the first aspect, wherein the ceramic coating covers an area including a boundary portion in the rear portion in which the base metal member and the nozzle chip are in contact with each other and extending up to a peripheral portion of the nozzle chip.

In such a configuration, coating an area including the boundary portion at which the base metal member and the nozzle chip are in contact with each other can prevent the fluid from accessing the base metal member through the boundary portion, whereby metal contained in the base metal member can be more reliably prevented from dissolving into the fluid.

A third aspect of the present invention is the fluid nozzle according to the first or second aspect, wherein the ceramic coating is a titanium nitride coating or a titanium aluminium nitride coating.

Such a configuration enables formation of a stable ceramic coating at an appropriate portion.

A fourth aspect of the present invention is the fluid nozzle according to any one of the first to third aspects, wherein the base metal member includes a base portion and a sintered metal portion embedded in the base portion, wherein the sintered metal portion has an annular shape so as to surround a circumferential portion of the nozzle chip, and wherein the nozzle chip is fixed to the base portion by sintering the sintered metal portion.

Such a configuration allows the nozzle chip to be stably and firmly joined with the base portion by sintering the sintered metal, whereby a highly precise, stable water jet can be obtained using the nozzle chip having a high holding power and a high rigidity.

A fifth aspect of the present invention is the fluid nozzle according to the fourth aspect, wherein the sintered metal portion is made of nickel or an alloy containing nickel as a main component, and wherein the nozzle chip is made of a mineral crystal having a Mohs hardness of 9 or higher.

In such a configuration, the material of the nozzle chip can be preferably selected from mineral crystal materials having a Mohs hardness of 9 or higher and having an excellent strength and durability such as, diamond, sapphire, corundum, or cubic boron nitride, since nickel or an alloy containing nickel as a main component is easily joined to and fused with a crystalline material such as diamond or sapphire by sintering.

Thus, a highly precise, stable water jet can be obtained using the nozzle chip having improved rigidity and durability.

The fluid nozzle according to an aspect of the present invention having the above-described configuration can form a highly precise, stable water jet and can have improved rigidity and durability.

In other words, by preventing metal contained in the base metal member from dissolving into the supplied fluid, the flow of the fluid can be prevented from being disturbed due to the dissolved metal having adhered to the surface of the nozzle chip as a result of pressure induced crystallization. Thus, the fluid nozzle according to an aspect of the present invention can keep the surface of the nozzle chip in normal condition, so that the flow of the fluid at the circumferential portion of the inlet port becomes stable and the water jet is prevented from being deviated. Thus, a highly precise, stable water jet can be obtained.

The fluid nozzle according to an aspect of the present invention can have higher heat durability (heat resistance) and higher mechanical strength by using a base metal member to hold the nozzle chip. Thus, besides having a function of preventing metal from adhering to the nozzle chip, the fluid nozzle can have improved rigidity and durability and form a stable water jet. The fluid nozzle according to an aspect of the present invention is thus preferably usable in, besides a water jet processing machine, a water beam processing machine.

BRIEF DESCRIPTION OF THE DRAWINGS

FIG. 1A is a vertical section of the fluid nozzle and FIG. 1B is a plan view of the fluid nozzle.

FIG. 4A is a vertical section of the fluid nozzle and FIG. 4B is a plan view of the fluid nozzle.

FIG. 5A is a vertical section of the fluid nozzle and FIG. 5B is a plan view of the fluid nozzle.

FIG. 7A is a vertical section of the fluid nozzle and FIG. 7B is a plan view of the fluid nozzle.

DESCRIPTION OF THE PREFERRED EMBODIMENTS

First Embodiment

Figure 1A:
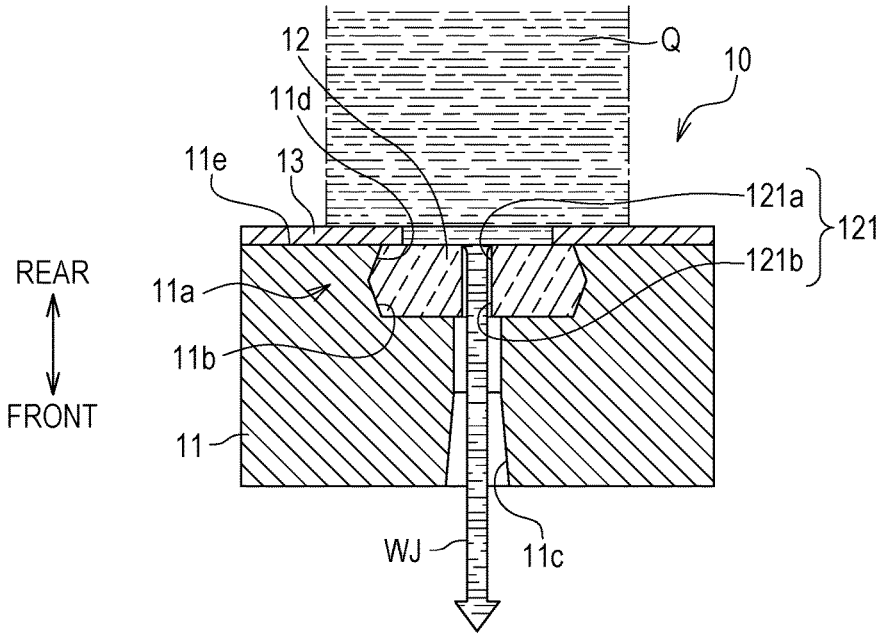
FIGS. 1A and 1B illustrate a fluid nozzle according to a first embodiment of the present invention where
Figure 1B:
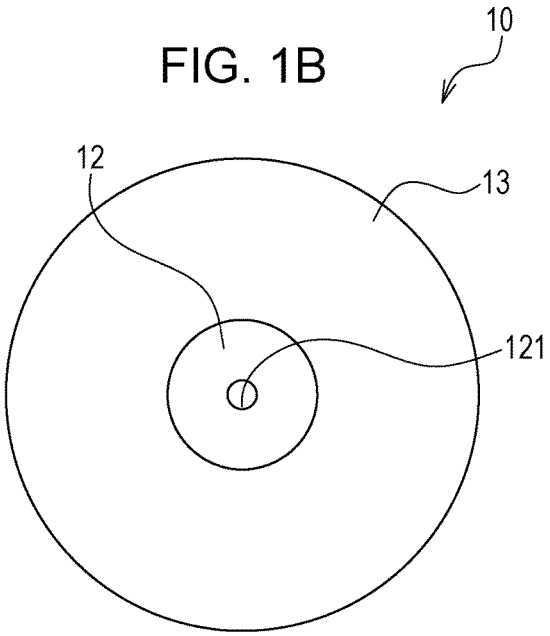

Referring to FIGS. 1A and 1B, a fluid nozzle 10 according to a first embodiment of the present invention is described. For convenience of illustration, throughout the drawings to be referred to, the dimensions such as the sizes of components, the diameter of a nozzle, or the thickness of a ceramic coating are not particularly limited and thus illustrated in an exaggerated manner.

The fluid nozzle 10 includes a nozzle chip 12 in which a through hole 121 is formed, a base metal member 11 that supports the nozzle chip 12 embedded therein, and a ceramic coating 13 that covers an exposed portion 11*e* of the base metal member 11 that is exposed to a high-pressure fluid (for example, water or pure water, referred to as "a high-pressure water Q", below). The through hole 121 serves as a nozzle hole through which the high-pressure water Q is supplied.

The fluid nozzle 10 ejects the supplied high-pressure water Q from the through hole 121, serving as a nozzle hole, to form a water jet WJ (liquid column jet).

In the following description of the fluid nozzle 10, for convenience of illustration, a portion of the fluid nozzle 10 on the downstream side in the direction in which the water jet WJ is ejected is referred to as a front portion of the fluid nozzle 10 and a portion of the fluid nozzle 10 on the upstream side in the direction in which the water jet WJ is ejected is referred to as a rear portion of the fluid nozzle 10.

The base metal member 11 has a recess (insertion portion) 11*b* in a rear portion 11*a* for holding the nozzle chip 12 and a clearance hole 11*c* that allows the water jet WJ to pass therethrough. The base metal member 11 is made of a metal material that has a sufficiently high strength to firmly fix the nozzle chip 12. For example, in the case where the base metal member 11 is formed of a sintered metal, the base metal member 11 and the nozzle chip 12 can be integrated together by sintering so as to be highly precisely positioned with respect to each other by being firmly fixed to each other.

Forming the base metal member 11 using a sintered metal is particularly preferable because, when the base metal member 11 is made of nickel (Ni) or a nickel chrome alloy containing nickel (Ni) as a main component, the nozzle chip 12 can be made of a mineral crystal having a Mohs hardness of 9 or higher such as diamond, corundum, or cubic boron nitride, whereby the nozzle chip 12 can have improved heat resistance and durability.

Since the nozzle chip 12 is embedded in and held by the base metal member 11 having higher rigidity than resin or other materials, the nozzle chip 12 has sufficiently high strength against the flow of the supplied high-pressure water Q, the impact pressure (water hammer) that occurs as a result of impact, or other forces such as a tight fastening force that occurs when the nozzle chip 12 is fixed to or inserted into the base metal member 11.

The nozzle chip 12 having this configuration is not subjected to damages such as detachment or corrosion and thus can bear long term use.

The fluid nozzle 10 according to the embodiment of the present invention can thus preferably be used in a nozzle unit 30 (see FIG. 2) of a water jet processing machine and a nozzle unit 40 (see FIG. 3) of a water beam processing machine, which are described below.

In this embodiment, the nozzle chip 12 is embedded in the base metal member 11 while being held in the rear portion 11*a* of the base metal member 11 in such a manner that the nozzle chip 12 is flush with the rear end surface on the rear portion 11*a* so as not to disturb the flow of the high-pressure water Q. However, the configuration is not limited to this. As long as the nozzle chip 12 does not disturb the flow of the high-pressure water Q, the nozzle chip 12 may be disposed in other ways in accordance with the form of introducing the high-pressure water Q, for example, the nozzle chip 12 may be buried under the rear end surface or may protrude from the rear end surface.

The through hole 121 formed in the nozzle chip 12 includes an inlet port 121*a*, from which the high-pressure water Q is introduced, and an outlet port 121*b* from which the introduced high-pressure water Q is ejected in the form of a water jet WJ.

The nozzle chip 12 is made of a material having high abrasion resistance and strength with which the material is not deformed by the pressure from the high-pressure water Q. Examples usable as the material for the nozzle chip 12 include diamond, corundum, cubic boron nitride, topaz, quartz, and other crystalline materials. Desirably, a mineral monocrystal having a Mobs hardness of 9 or higher is used as a material of the nozzle chip 12. The use of the mineral having a Mohs hardness of 9 or higher allows formation of a highly precise through hole 121, whereby a highly precise water jet WJ can be formed. In addition, the use of a monocrystal material having a high hardness improves the abrasion resistance, whereby the life of the nozzle 10 can be extended. The nozzle chip 12 is mounted on the base metal member 11 in such a manner that the through hole 121 and the clearance hole 11*c* formed in the base metal member 11 are coaxial with each other.

The ceramic coating 13 is disposed so as to cover at least the exposed portion 11*e* on the rear portion 11*a* of the base metal member 11 that is exposed to the high-pressure water Q.

Specifically, the ceramic coating 13 covers at least the exposed portion 11*e* on the rear portion 11*a* of the base metal member 11 that is exposed to the high-pressure water Q in the state where the nozzle chip 12 is embedded in the rear portion 11*a* of the base metal member 11. Desirably, the ceramic coating 13 covers an area including a boundary portion 11*d* between the base metal member 11 and the nozzle chip 12 and extending up to a peripheral portion of the nozzle chip 12. However, it is preferable that the ceramic coating 13 do not cover the circumferential portion (near an edge portion) of the inlet port 121*a* so as not to affect the flow of the high-pressure water Q.

Examples usable as the ceramic coating 13 include TiN (titanium nitride), TiAlN (titanium aluminium nitride), and other ceramic coatings. The TiN or TiAlN coating is made by physical vapor deposition (PVD). Here, the circumferential portion of the inlet port 121*a* is masked with a preformed coating containing TiO2 (titanium oxide). The deposition coating is not formed on the portion masked with the TiO2 coating and thus is not formed on the circumferential portion of the inlet port 121*a*. As illustrated in FIG. 1B, the ceramic coating 13 does not adhere to the circumferential portion of the inlet port 121*a* and thus the circumferential portion of the inlet port 121*a* of the nozzle chip 12 is exposed.

The configuration in which the circumferential portion of the inlet port 121*a* of the nozzle chip 12 is exposed allows the highly precisely processed nozzle chip having rigidity and durability to perform its intrinsic performance, whereby the flow of the fluid can be kept stable and a highly precise, stable water jet WJ can be formed.

Specifically, as illustrated in FIG. 1A, the flow of the high-pressure water Q is narrowed at the inlet port 121*a* of the fluid nozzle 10 so as to form a water jet WJ that passes through the through hole 121 without touching the circumferential wall of the through hole 121. Thus, the configuration and the form of the inlet port 121*a* and its vicinity are important and the surface roughness, the dimensional accuracy, and other properties have to be highly precisely managed. The fluid nozzle 10 according to the embodiment is designed to allow the highly precisely processed nozzle chip 12 having rigidity and durability to perform its own performance by not providing the ceramic coating 13 around the inlet port 121*a*.

The ceramic coating can be formed not by physical vapor deposition but by chemical vapor deposition (CVD) or other deposition. The method for keeping a portion around the inlet port 121*a* out of a ceramic coating can be appropriately selected from various different coating methods.

The method for keeping a portion out of the ceramic coating (masking method) is not particularly limited and may be appropriately selected from various known methods in consideration of various factors such as the method for forming a coating, the type of a coating that is formed, or the material of the base metal member 11.

Figure 2:
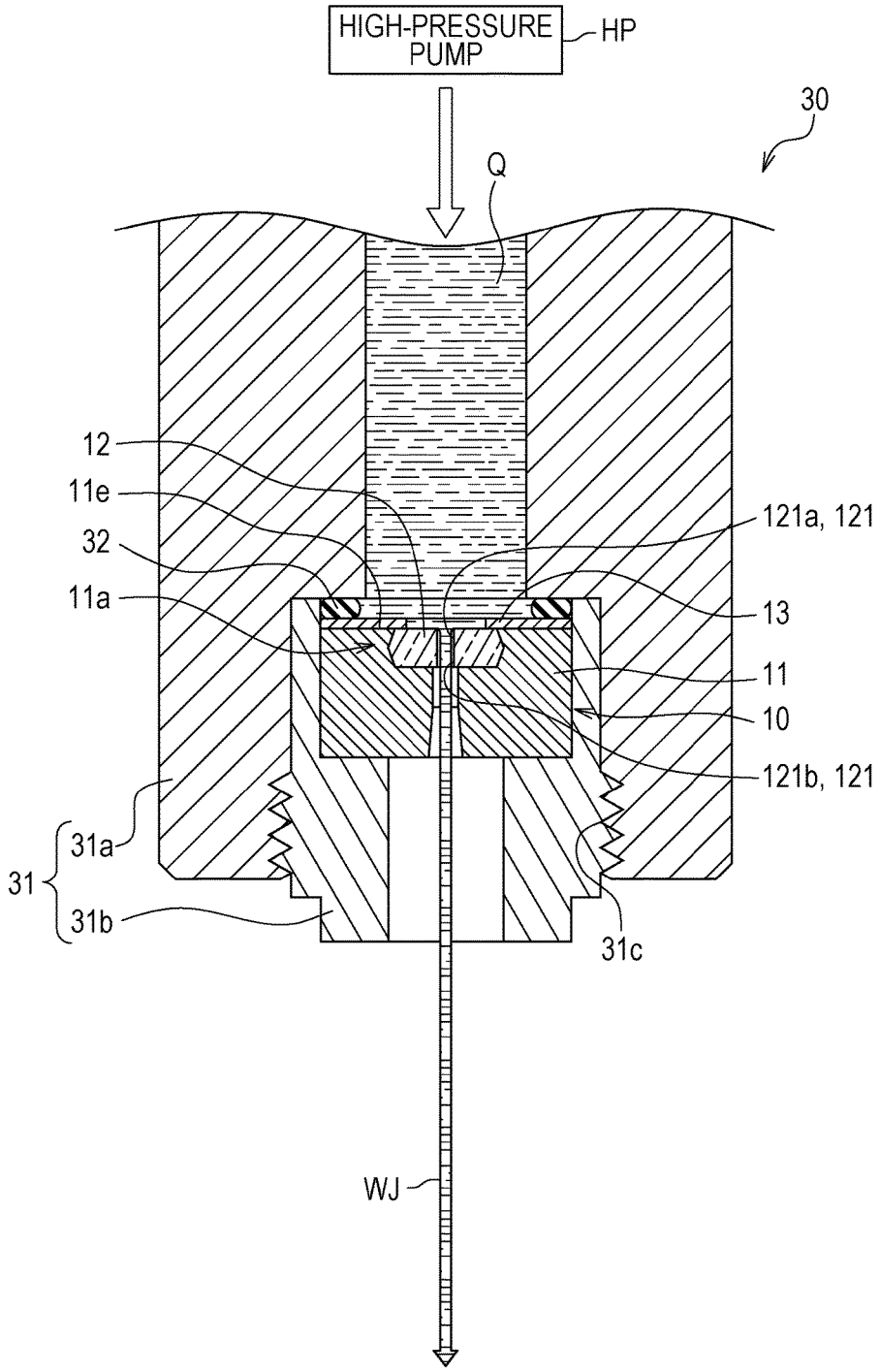
FIG. 2 is a vertical section of a nozzle unit of a water jet processing machine in which the fluid nozzle according to the first embodiment of the invention is used.
Figure 3:
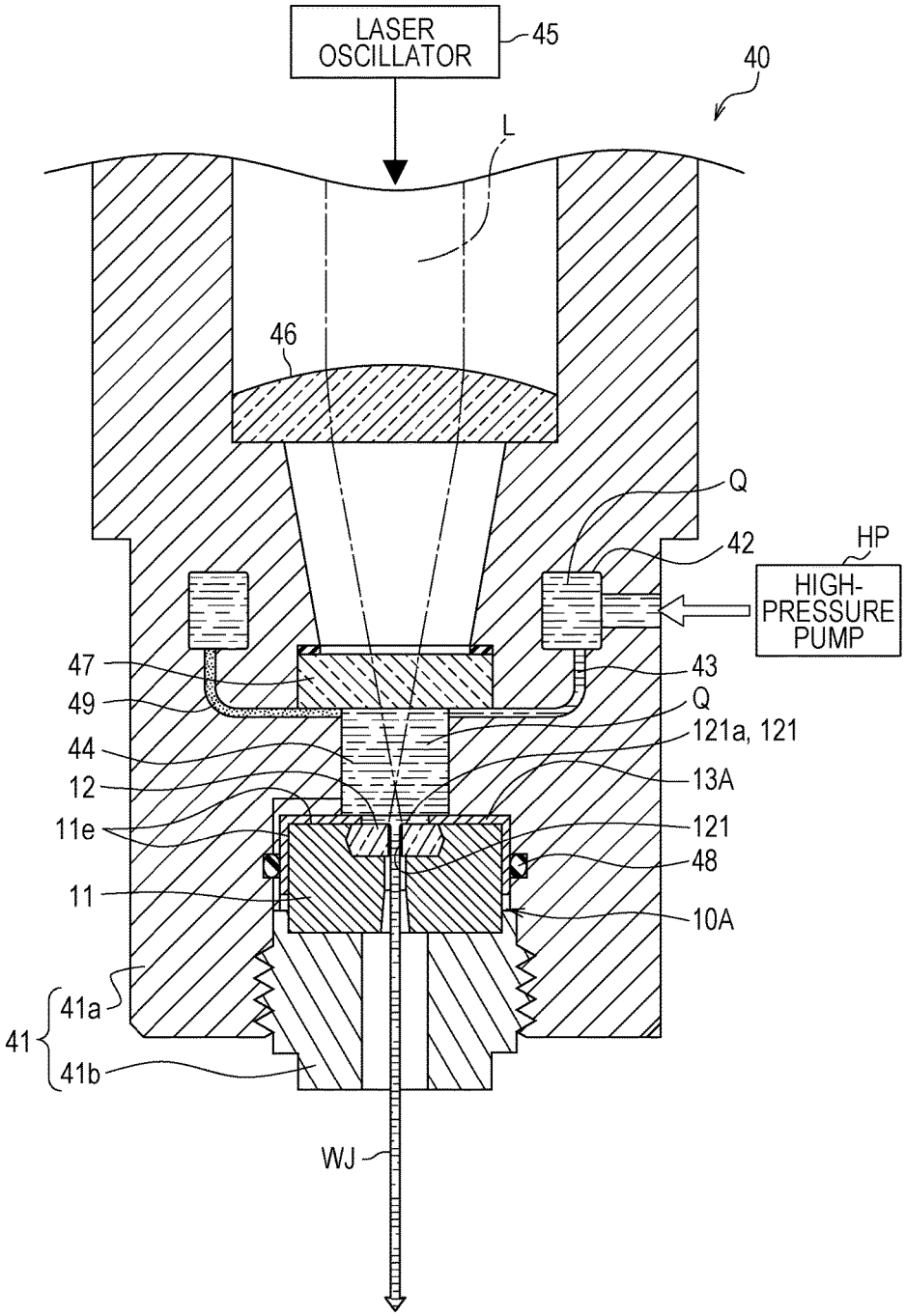
FIG. 3 is a vertical section of a nozzle unit of a water beam processing machine in which the fluid nozzle according to the first embodiment of the invention is used.

Referring now to FIGS. 2 and 3, the cases where the fluid nozzle 10 according to the first embodiment of the present invention is used in a nozzle unit 30 (see FIG. 2) of a water jet processing machine and in a nozzle unit 40 (see FIG. 3) of a water beam processing machine are described. FIG. 2 is a vertical section of a nozzle unit 30 of a water jet processing machine in which the fluid nozzle 10 is used and FIG. 3 is a vertical section of a nozzle unit 40 of a water beam processing machine in which the fluid nozzle 10 is used.

Use in Water Jet Processing Machine

As illustrated in FIG. 2, the nozzle unit 30 of the water jet processing machine includes a fluid nozzle 10 that ejects a high-pressure water Q supplied from a high-pressure pump HP, a nozzle holder 31 that holds the fluid nozzle 10, and a seal member 32 that prevents leakage of the high-pressure water Q.

The nozzle holder 31 includes a pipe-shaped body 31*a* and a nozzle fixing member 31*b* disposed in the body 31*a*.

The body 31*a* has a recess (insertion portion) in a front end portion (a lower portion in the drawing) in which the nozzle fixing member 31*b* is disposed. On the circumferential portion of the recess, triangular threads 31*c* are formed. The triangular threads 31*c* allow the nozzle fixing member 31*b* to be screwed into the body 31*a*.

The nozzle fixing member 31*b* holds the fluid nozzle 10 to fix the fluid nozzle 10 to the body 31*a*.

The nozzle fixing member 31*b* has a recess (insertion portion) in a rear portion (a top portion in the drawing) into which the fluid nozzle 10 is embedded and the fluid nozzle 10 is inserted and fitted into the recess. A rear portion (a top portion in the drawing) of the nozzle fixing member 31*b* is inserted and fitted into the insertion portion of the body 31*a*.

The outer circumferential portion of the fluid nozzle 10 having such a configuration is fitted into the body 31*a* with the nozzle fixing member 31*b* interposed therebetween, whereby the fluid nozzle 10 is fixed to the nozzle holder 31 at a high dimensional accuracy.

The body 31*a* and the nozzle fixing member 31*b* of the nozzle holder 31 are made of a metal that is less likely to be dissolved into the high-pressure water Q and that has a corrosion resistance. Desirably, a titanium (Ti) alloy is used, but a precipitation hardening or austenitic stainless steel is also usable.

The seal member 32 is an O-ring and is disposed between the rear portion 11*a* (an upper portion of the drawing) of the fluid nozzle 10 and a bottom portion (an upper portion of the drawing) of the recess of the body 31*a*. The seal member 32 is made of natural rubber, ethylene propylene diene monomer (EPDM) rubber, nitrile butadiene rubber (NBR), or other synthetic rubber. In the case where workpieces (not illustrated) are components (such as electronic components) that can be easily harmed by contamination of impurities, the use of a seal member made of EPDM rubber is desirable.

Pure water is used as the high-pressure water Q and the high-pressure water Q is supplied from the high-pressure pump HP through the nozzle holder 31 to the rear portion 11*a* of the fluid nozzle 10. The nozzle chip 12 reduces the flow of the high-pressure water Q supplied, with pressure, to the rear portion 11*a* of the fluid nozzle 10 by introducing the high-pressure water Q from the inlet port 121*a* and ejects the high-pressure water Q from the outlet port 121*b* in the form of a water jet WJ. The ejected water jet WJ impacts against a workpiece (not illustrated) so as to process the workpiece in accordance with the momentum of the water jet WJ. The processing point is a point at which the water jet WJ comes into contact with (impacts against) the workpiece.

Thus, for a particularly precise processing, the water jet WJ is required to be ejected so as to be coaxial with a nozzle fixing axis. When the water jet WJ is coaxial with the nozzle fixing axis, water jet processing can be highly precisely performed by precisely controlling the nozzle fixing axis using a multi-axis robot or a numerical control device.

Use in Water Beam Processing Machine

As illustrated in FIG. 3, a nozzle unit 40 of a water beam processing machine includes a fluid nozzle 10A, a nozzle holder 41, a high-pressure pump HP that produces a high-pressure water Q, a flow-adjusting chamber 42 in which the turbulence of the high-pressure water Q supplied from the high-pressure pump HP is reduced, a liquid oscillating chamber 44, which guides a liquid that flows thereinto from the flow-adjusting chamber 42 to an entrance of the nozzle opening, a laser oscillator 45, a focusing lens 46 that focuses a laser beam L output from the laser oscillator 45, a window 47 that allows the laser beam L to pass therethrough, and a seal member 48 that prevents leakage of the high-pressure water Q.

The fluid nozzle 10A is different from the fluid nozzle 10 illustrated in FIG. 1 in terms that the fluid nozzle 10A has a ceramic coating 13A that covers an area extending from the rear end surface to a portion of the outer circumferential surface of the fluid nozzle 10A, whereas the fluid nozzle 10 has a ceramic coating 13 that covers the rear end surface of the fluid nozzle 10.

The ceramic coating 13A of the fluid nozzle 10A is the same as the ceramic coating 13 of the fluid nozzle 10 illustrated in FIG. 1 in terms that the ceramic coating 13A covers the exposed portion 11*e* of the base metal member 11 so as to prevent the base metal member 11 from being exposed to a high-pressure water Q. Other configuration of the ceramic coating 13A is similar to that of the ceramic coating 13A and is thus not redundantly described.

The nozzle holder 41 includes a pipe-shaped body 41*a* and a nozzle fixing member 41*b* disposed inside the body 41*a*. The nozzle holder 41 has a similar configuration as the nozzle holder 31 of the nozzle unit 30 illustrated in FIG. 2 and is thus not described in detail.

The flow-adjusting chamber 42 is an annular space having a substantially rectangular cross section. The flow-adjusting chamber 42 is disposed above the liquid oscillating chamber 44 in the nozzle holder 41. A circular-tray-shaped space is formed below the flow-adjusting chamber 42. Only a sector of the circular-tray-shaped space having a center angle of approximately 90° is left empty and the remaining portion of the circular-tray-shaped space is filled with an oscillating-chamber-inlet-path adjusting member 49. Thus, a substantially horizontal, sector-shaped flat space having a center angle of approximately 90° expands from the center of the nozzle holder 41 and a thin space having an arc shape when viewed in plan rises vertically from the circumferential arcuate portion of the sector-shaped flat space. This inner space formed by cutting the circular tray into a sector having a center angle of approximately 90° serves as an oscillating-chamber inlet path 43. The oscillating-chamber inlet path 43 connects the flow-adjusting chamber 42 and the cylindrical liquid oscillating chamber 44 together.

The high-pressure water Q supplied from the high-pressure pump HP flows into the flow-adjusting chamber 42, passes through the oscillating-chamber inlet path 43, and then flows into the liquid oscillating chamber 44 from only one direction. The high-pressure water Q is ejected from the liquid oscillating chamber 44 through a through hole 121 formed at the center of the fluid nozzle 10A in the form of a water jet WJ into which a laser beam L is guided.

The laser beam L output from the laser oscillator 45 is focused by the focusing lens 46, passes through the window 47, is converged at a position slightly above the inlet port 121*a*, and is guided into the water jet WJ. The laser beam L guided into the water jet WJ is incident on a workpiece (not illustrated) and processes the workpiece with its energy.

In order to lower the ratio at which the laser beam L is absorbed by the high-pressure water Q, the nozzle unit 40 used in the water beam processing machine is required to eject a high-pressure water Q having a lowest possible conductivity. Thus, a material such as a Ti alloy or a precipitation hardening stainless steel is used for a portion made of metal, such as the nozzle holder 41, that comes into contact with the high-pressure water Q.

Figure 4A:
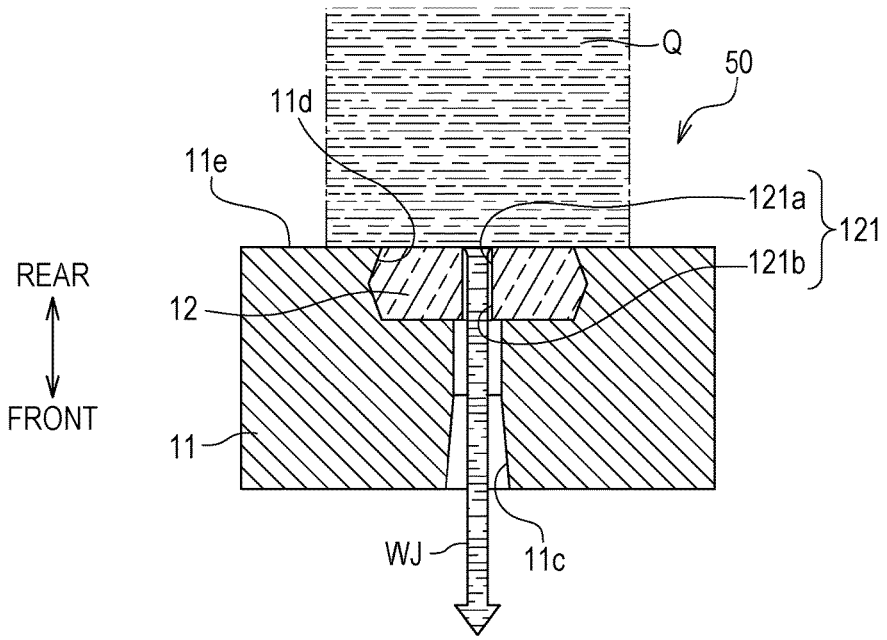
FIGS. 4A and 4B illustrate a fluid nozzle according to a comparative example to illustrate an operation effect of the fluid nozzle according to the first embodiment of the present invention, where
Figure 4B:
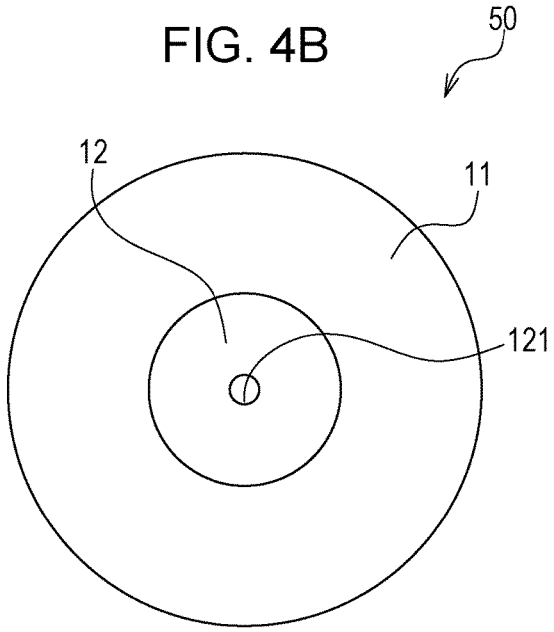
Figure 5A:
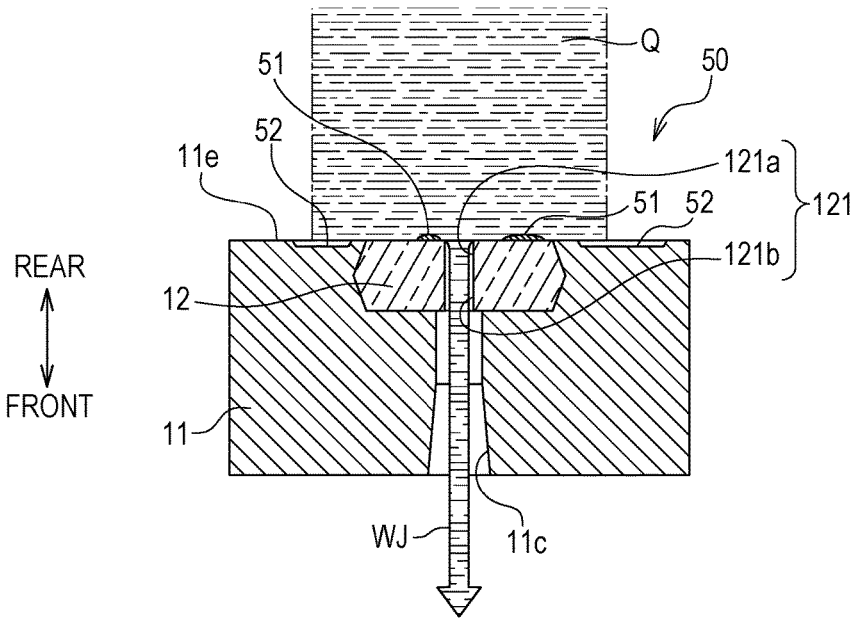
FIGS. 5A and 5B illustrate the state where crystallized metal adheres to a fluid nozzle according to a comparative example where
Figure 5B:
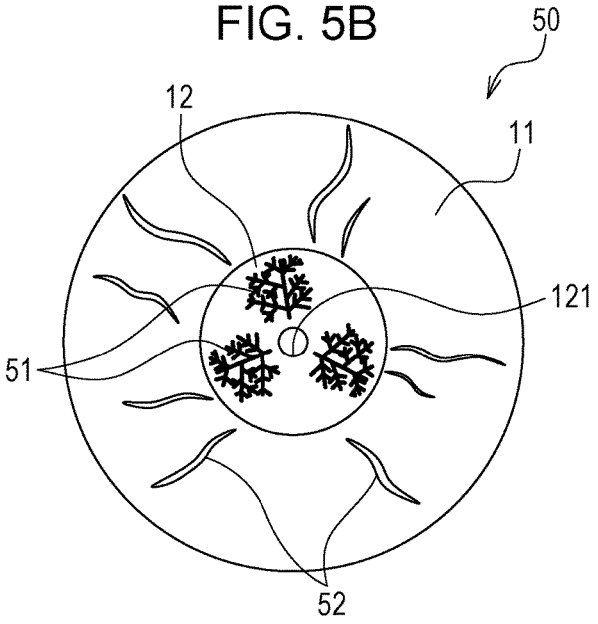

Now, operation effects of the fluid nozzle 10 according to the first embodiment of the present invention (and the fluid nozzle 10A, which has the same effects) are described in comparison with a fluid nozzle 50 (FIGS. 4A to 6) according to a comparative example that does not include a ceramic coating. FIGS. 4A and 4B illustrate the configuration of the fluid nozzle 50 according to the comparative example that does not include a ceramic coating, where FIG. 4A is a vertical section of the fluid nozzle 50 and FIG. 4B is a plan view of the fluid nozzle 50. FIGS. 5A and 5B illustrate operation effects of the fluid nozzle 50 according to the comparative example that does not include a ceramic coating, where FIG. 5A is a vertical cross section of the fluid nozzle 50 and FIG. 5B is a plan view of the fluid nozzle 50.

As illustrated in FIGS. 1A and 1B, the fluid nozzle 10 according to the first embodiment of the present invention is different from the fluid nozzle 50 according to the comparative example illustrated in FIGS. 4A and 4B in terms that the fluid nozzle 10 includes a ceramic coating 13 that is disposed so as to cover an area including a rear portion 11*a* of the base metal member 11, a boundary portion 11*d* at which the base metal member 11 and the nozzle chip 12 are in contact with each other, and the peripheral portion of the nozzle chip 12, whereas the fluid nozzle 50 does not include a ceramic coating. Components of the fluid nozzle 50 according to the comparative example illustrated in FIGS. 4A to 5B that are the same as those of the fluid nozzle 10 illustrated in FIGS. 1A and 1B are thus denoted by the same reference symbols and are not described in detail.

In the fluid nozzle 10 according to the first embodiment, the exposed portion 11*e* (a portion that comes into contact with the high-pressure water Q) of the base metal member 11 is covered by the ceramic coating 13. Thus, the base metal member 11 does not come into contact with the high-pressure water Q and metal ions are not dissolved into the high-pressure water Q from the base metal member 11. Consequently, precipitation of metal from the high-pressure water Q (adherence of metal) to the nozzle chip 12 can be avoided. Since crystallized metal does not adhere to a portion around the inlet port 121*a* of the nozzle chip 12, the flow of water around the inlet port 121*a* is not disturbed and thus the water jet WJ is highly precisely ejected along the nozzle center axis.

On the other hand, in the fluid nozzle 50 according to the comparative example illustrated in FIG. 4 that does not include a ceramic coating, a rear portion of the base metal member 11 of the fluid nozzle 50 is exposed and thus the exposed portion 11*e* of the base metal member 11 comes into contact with the high-pressure water Q.

Thus, in a nozzle unit 80 of a water beam processing machine including the fluid nozzle 50 according to the comparative example, metal (metal ions) contained in the base metal member 11 dissolves into the high-pressure water Q since the base metal member 11 is exposed to the high-pressure water Q supplied to the fluid nozzle 50.

The high pressure of the high-pressure water Q conceivably induces a phenomenon that the metal (dissolved metal) that has dissolved into the high-pressure water Q precipitates in the form of crystal around the inlet port 121*a* of the nozzle chip 12 (the phenomenon is referred to as pressure induced crystallization).

Specifically, as illustrated in FIGS. 5A and 5B, since metal of the base metal member 11 dissolves into the high-pressure water Q, the dissolution of metal causes formation of groove-shaped recesses 52 on the rear end surface of the base metal member 11. Crystallized metal 51 having various shapes deposited due to the pressure induced crystallization adheres to the surface of the nozzle chip 12 so as to protrude from the surface.

The crystallized metal 51 is a crystal of metal formed as a result of the dissolved and deposited metal growing into a shape of a snow crystal (or cedar leaves) so as to extend outward from an edge portion of the inlet port 121*a*. The crystallized metal 51 is not observed on the wall surface (circumferential surface) of the through hole 121.

The inventors believe that the mechanism by which the crystallized metal 51 adheres to the surface of the nozzle chip 12 occurs because, metal ions in the base metal member 11 made of a sintered metal dissolve into the high-pressure water Q and the dissolved metal ions adhere to the surface of the nozzle chip 12. Specifically, the base metal member 11 is made of metal that is easily joined to and fused with the nozzle chip 12 by sintering and the high-pressure water Q inside the liquid oscillating chamber 44 is compressed by high pressure. Thus, by receiving the pressure, the dissolved portion of the sintered metal precipitates and adheres to the nozzle chip 12 with which the dissolved metal is compatible (to and with which the dissolved metal is easily joined and fused and thus to which the dissolved metal easily adheres).

Figure 6:
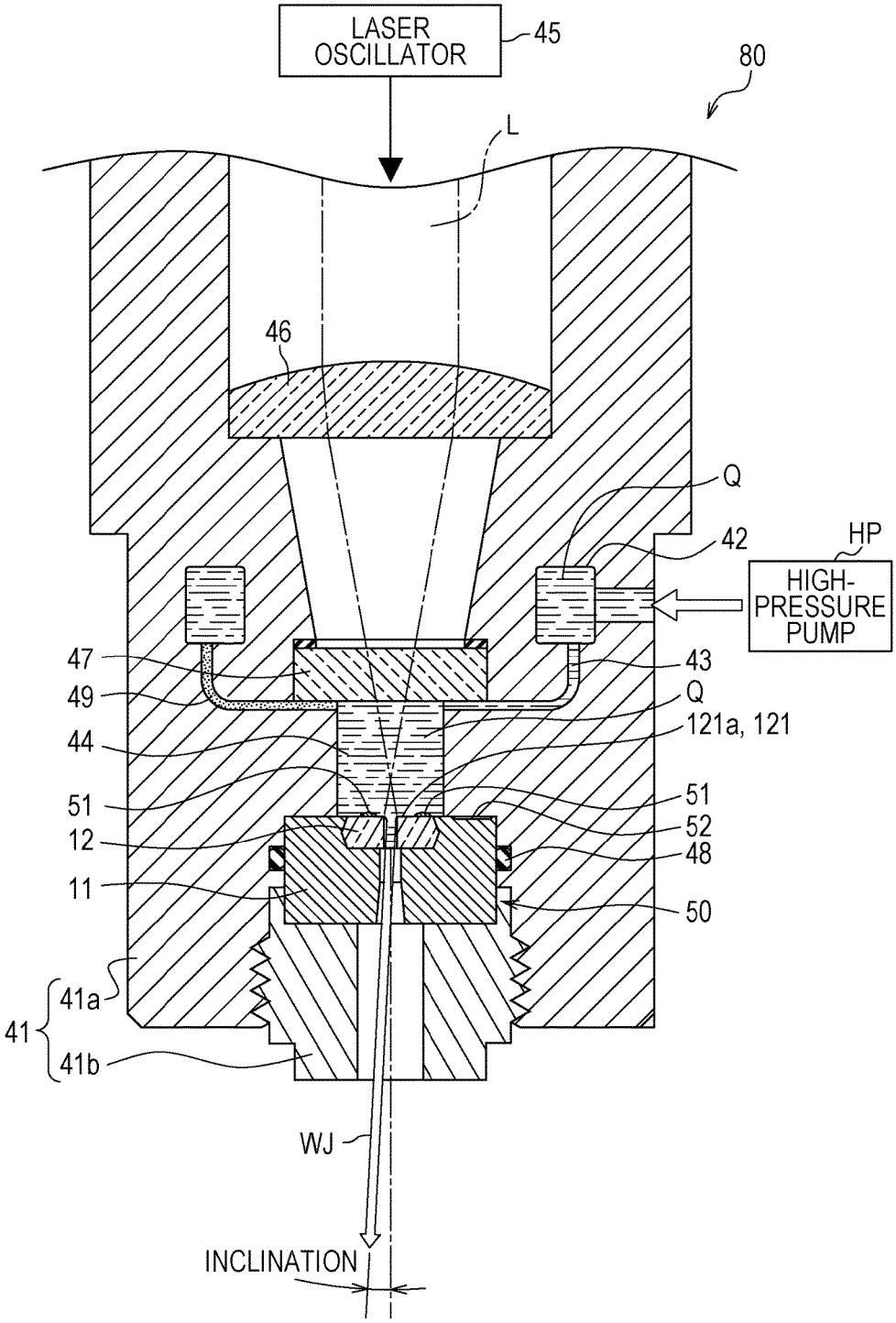
FIG. 6 is a vertical section illustrating an operation effect obtained when the fluid nozzle according to the comparative example is used in a water beam processing machine.

As illustrated in FIG. 6, after the crystallized metal 51 adheres to the surface of the nozzle chip 12, the water jet WJ ejected from the fluid nozzle 50 inclines away from the axis of the fluid nozzle 50. In the fluid nozzle 50 having the above-described configuration, the flow of a fluid is conceivably narrowed by receiving irregular resistance around the inlet port 121*a* and directed in an inclined direction so as to be formed into an unstable water jet WJ. As described above, a portion around the inlet port 121*a* has an important function of forming a jet. Thus, adherence of the crystallized metal 51 to a portion around the inlet port 121*a* is considered to largely affect the inclination of the water jet WJ.

During processing using the nozzle unit 80 included in a water beam processing machine, the laser beam L propagates through the water jet WJ. Thus, the process point of a workpiece (not illustrated) is a point at which the water jet WJ comes into contact with the workpiece. Since the water jet WJ deviates from the center axis of the nozzle, that is, the line extended from the center axis of the nozzle unit 80, the process point deviates from the extended line. Such deviation hinders production of highly precise products even when the nozzle unit 80 is precisely moved by a numerically controlled apparatus. Particularly, such deviation affects critically adversely when the nozzle unit 80 and the workpiece three-dimensionally change their positions.

Second Embodiment

Figure 7A:
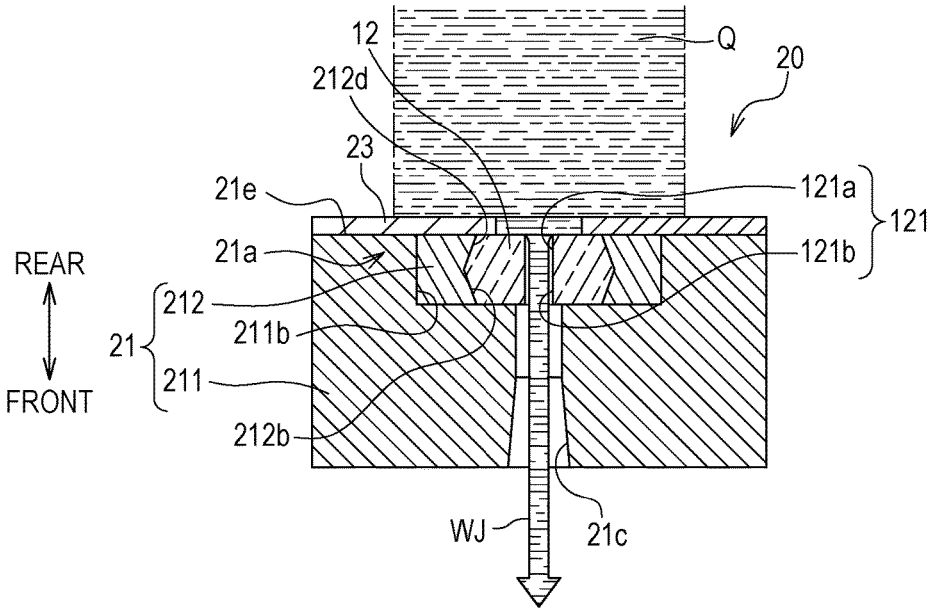
FIGS. 7A and 7B illustrate a fluid nozzle according to a second embodiment of the present invention where
Figure 7B:
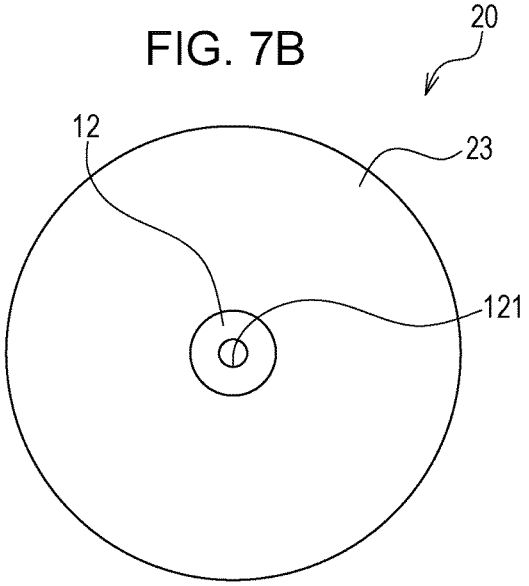

Referring to FIGS. 7A and 7B, a fluid nozzle 20 according to a second embodiment of the present invention is described. The fluid nozzle 20 is different from the fluid nozzle 10 according to the first embodiment in terms that the base metal member 21 includes a base portion 211 and a sintered metal portion 212 embedded in the base portion 211.

Thus, the fluid nozzle 20 is different from the fluid nozzle 10 according to the first embodiment in terms that the ceramic coating 23 covers an area including the exposed portion 21*e* on the rear portion 21*a* of the base metal member 21 that is exposed to the high-pressure water Q, the base portion 211, the sintered metal portion 212, a boundary portion 212*d* between the sintered metal portion 212 and the nozzle chip 12, and extending up to a peripheral portion of the nozzle chip. However, other components of the fluid nozzle 20 are the same as those of the fluid nozzle 10 and thus are denoted by the same reference symbols and not described in detail.

The base portion 211 of the base metal member 21 is a member that supports the nozzle chip 12 and the sintered metal portion 212. The base portion 211 has a recess 211*b* in the rear portion 21*a* for holding the nozzle chip 12 and the sintered metal portion 212.

The sintered metal portion 212 is formed in an annular shape so as to cover the circumference of the nozzle chip 12. The nozzle chip 12 is fixed to the base portion 211 by sintering the sintered metal portion 212. The sintered metal portion 212 is a member that supports the nozzle chip 12 and has a recess 212*b* that holds the nozzle chip 12. The sintered metal portion 212 is made of a metal that is easily joined to the base portion 211 and the nozzle chip 12 by sintering, which is the same material as that of the base metal member 11 of the fluid nozzle 10 according to the first embodiment.

In the fluid nozzle 20 according to the second embodiment, the base portion 211 that makes up a large proportion to the entire base metal member 21 can be made of a metal that is less likely to dissolve into pure water and that is more strong and more easily workable. Examples of the materials of the base portion 211 include a Ti alloy and a precipitation hardening stainless steel. Thus, the nozzle 20 can have higher dimensional accuracy and longer durability and reduce the amount of metal dissolved into pure water compared to the case of the fluid nozzle 10 according to the first embodiment. Consequently, the fluid nozzle 20 can form a more highly stable water jet WJ while the amount of metal adhering to the nozzle chip 12 is reduced further than the fluid nozzle 10 according to the first embodiment.

What is claimed is:

1. A fluid nozzle, comprising:

a nozzle chip made of a mineral crystal having a Mohs hardness of 9 or higher and including a through hole having an inlet port from which a fluid supplied to the fluid nozzle is introduced and an outlet port from which the introduced fluid is ejected, a base metal member that supports the nozzle chip embedded in a rear portion of the base metal member, and a ceramic coating layer covering an exposed portion of the base metal member so that the base metal member does not come into contact with the fluid, covering an area including a boundary portion in the rear portion in which the base metal member and the nozzle chip are in contact with each other, and covering a peripheral portion of the nozzle chip, wherein the fluid nozzle receives the fluid supplied to the rear portion from the inlet port and ejects the fluid from the outlet port.

2. The fluid nozzle according to claim 1, wherein the ceramic coating is a titanium nitride coating or a titanium aluminum nitride coating.

3. The fluid nozzle according to claim 1, wherein the base metal member includes a base portion and a sintered metal portion embedded in the base portion, wherein the sintered metal portion has an annular shape so as to surround a circumferential portion of the nozzle chip, and wherein the sintered metal portion fixes the nozzle chip to the base portion.

4. The fluid nozzle according to claim 3, wherein the sintered metal portion is made of nickel or an alloy containing nickel as a main component.

5. The fluid nozzle according to claim 1, wherein the ceramic coating is a titanium nitride coating or a titanium aluminum nitride coating.

6. The fluid nozzle according to claim 1, wherein the base metal member includes a base portion and a sintered metal portion embedded in the base portion, wherein the sintered metal portion has an annular shape so as to surround a circumferential portion of the nozzle chip, and wherein the nozzle chip is fixed to the base portion by sintering the sintered metal portion.

7. The fluid nozzle according to claim 6, wherein the sintered metal portion is made of nickel or an alloy containing nickel as a main component.

8. The fluid nozzle according to claim 2, wherein the base metal member includes a base portion and a sintered metal portion embedded in the base portion, wherein the sintered metal portion has an annular shape so as to surround a circumferential portion of the nozzle chip, and wherein the nozzle chip is fixed to the base portion by sintering the sintered metal portion.

9. The fluid nozzle according to claim 8, wherein the sintered metal portion is made of nickel or an alloy containing nickel as a main component.

* * * * *